US005771506A

United States Patent [19]

Joiner

[11] Patent Number: 5,771,506

[45] Date of Patent: Jun. 30, 1998

[54] PROTECTION APPARATUS

[76] Inventor: Glenda P. Joiner, 201 First St., Terrell, Tex. 79160

[21] Appl. No.: 734,993

[22] Filed: Oct. 22, 1996

[51] Int. Cl.[6] ..... A47K 3/12

[52] U.S. Cl. ..... 4/575.1; 4/579; 297/219.1; 5/663; 5/643

[58] Field of Search ..... 4/559, 571.1, 575.1, 4/580, 581, 582, 523, 655, 621, 578.1, 579; 5/630, 636, 640, 643, 417, 419, 420, 653, 655.9, 657, 948, 953, 663; 248/687, 118, 118.1; 297/219.1

[56] References Cited

U.S. PATENT DOCUMENTS

| | | | |
|---|---|---|---|
| Re. 15,708 | 10/1923 | Laidman | 5/420 |
| 190,854 | 5/1877 | Hatfield | 5/636 |
| 1,805,622 | 5/1931 | Goodwin | 4/579 |
| 1,872,846 | 8/1932 | Thiele | 5/417 |
| 2,188,421 | 1/1940 | Wade | 5/643 |
| 2,553,385 | 5/1951 | Ruth | 5/640 |
| 4,089,497 | 5/1978 | Miller et al. | 5/663 |
| 4,327,452 | 5/1982 | Swatzell | 4/523 |
| 4,385,408 | 5/1983 | Rhodes | 4/575.1 |
| 4,767,419 | 8/1988 | Fattore | 5/663 |

*Primary Examiner*—Charles R. Eloshway
*Attorney, Agent, or Firm*—Martin Sachs

[57] ABSTRACT

A protection apparatus for protecting elderly individuals that fall in a bathtub and hit their head on the edge thereof, as well as hospital patients who may cause damage to themselves by striking the restraining bars placed on a bed includes a longitudinally extending internal member adapted to be draped over a hard relatively narrow edge such as a bathtub; a first protective material covering the internal member top and bottom surfaces, a second protective covering completely covering the first protective covering and being completely sealed around the edges. The first protective covering is padded or sponge-like and will soften a blow protecting an individual who may fall thereagainst.

10 Claims, 2 Drawing Sheets

PROTECTION APPARATUS

BACKGROUND OF THE INVENTION

1. Field of the Invention

The present invention relates to protective appliances, and more particularly to a movable protection apparatus that helps to avoid head injuries, which may occur if an individual falls in a bathtub or if an individual hits his/her head against the side guardrail on a bed.

2. Brief Description of the Prior Art

Bathtubs have, over the years, been a hazard to elderly people that utilize them for bathing. The bottom portion typically has a slip free member placed thereon to prevent an individual from slipping and falling. Elderly persons frequently are unsteady on their feet and although a slip protection device is utilized, they frequently fall and hit their head or other parts of their body against the edges around the bathtub.

Many different types of headrests are designed for use in the bathtub, which are installed into recesses provided in the bathtub and come in many different sizes and shapes. However, the applicant is not aware of any device, which may be draped over the edge of a bathtub or easily moved to cover the protective guardrails, such as that used on a hospital bed, to prevent the individual from hitting his/her head thereon.

Bathtubs used by elderly persons in institutions or at home have one wall upon which a grab bar is placed to help the individual steady themselves getting into and out of the bathtub. However, the edge of the bathtub away from the wall is left exposed and if an individual should slip or fall that is the most likely place where they would be injured.

The present invention overcomes the shortcomings found in the prior art by providing a portable, movable protection apparatus, which may be draped over any relatively narrow edge e.g. a bathtub or guardrail placed on a bed.

SUMMARY OF INVENTION

It is an object of the present invention to provide a portable easily movable protection apparatus for use on the edge of a bathtub.

It is another object of the present invention to provide a padded bathtub protection assembly that will protect an individual if they should fall thereagainst.

It is still a further object of the invention to provide a portable, movable apparatus, which may be used to provide a padded protection for individuals that may fall thereagainst.

It is still a further object of the present invention to provide an inexpensive protection apparatus for use over the open edge of a bathtub.

In accordance with these and other objects of the invention, a protection apparatus includes a longitudinally extending internal member which has a top surface and a bottom surface for being draped over a hard relatively narrow edge such as a bathtub; a first protective material covers the internal apparatus top and bottom surfaces; and a second protective material is used to completely cover the first protective covering. The first protective covering is padded and provides protection from impact with an individual and the second protective covering is waterproof and slip free so that it may be draped over the open edge of a bathtub or placed on the guardrail of a bed.

The foregoing and other objects of advantages will appear for the description to follow. In the description reference is made to the accompanying drawing, which forms a part hereof, and which is shown by way of illustration the specific and alternative embodiments in which the invention may be practiced. These embodiments will be described in sufficient detail to enable those skilled in the art to practice the invention, and it is to be understood that other embodiments may be utilized and that structural changes may be made without departing from the spirit and scope of the invention. The following detailed description is, therefore, not to be taken in a limiting sense, and the scope of the present invention in best defined by the appended claims.

BRIEF DESCRIPTION OF THE DRAWING

In order that the invention may be more fully understood, it will now be described by way of example, with reference to the accompanying drawing in which.

DESCRIPTION OF THE PREFERRED EMBODIMENTS

Figure 1:
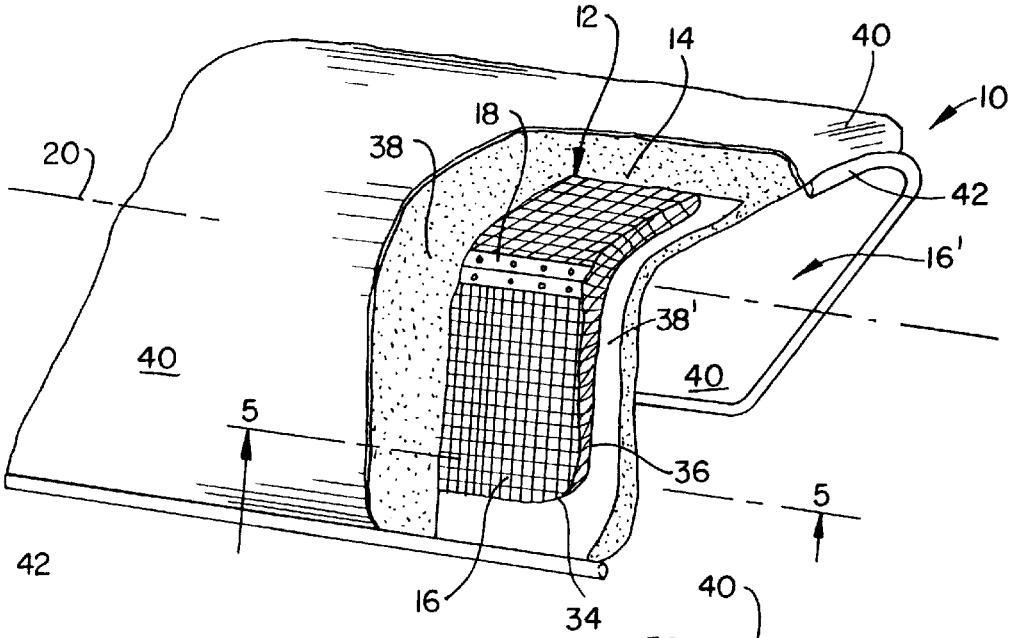
FIG. 1 is a pictorial representation of a protection apparatus, with a portion cut away, according to the principles of the present invention.
Figure 5:
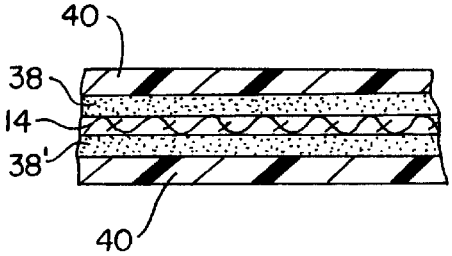
FIG. 5 is a greatly enlarged partial cross-sectional view of the apparatus shown in FIG. 1 taken along the line 5—5 of FIG. 1.
Figure 2:
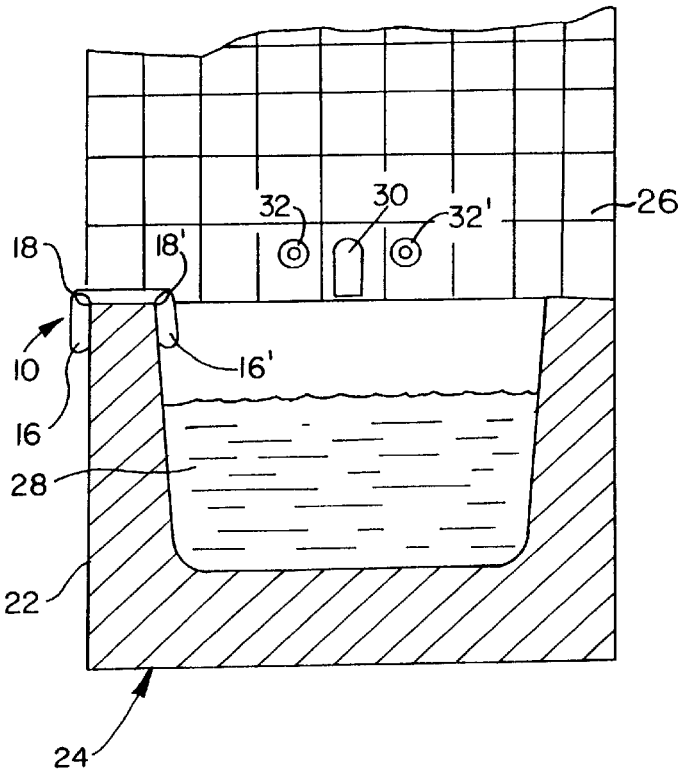
FIG. 2 is a cross-section of a bathtub filled with water showing the manner which the apparatus shown in FIG. 1 is draped over the relatively narrow edge of a bathtub.

Referring now to the figures, and in particular to FIG. 1, there is shown a protection apparatus 10, which is seen to include an internal member 12 that may be fabricated from a metallic mesh, a solid metal such as aluminum, steel or iron that is formed in a generally U-shape having a base portion 14 and arm portions 16 and 16'. The internal member 12 may also be formed with hinges 18 and 18' which are spaced apart from each other and extend along the longitudinal axis 20 of the protection apparatus 10. The hinges 18 and 18' are such that they exert pressure on the arms 16 and 16' to move them toward each other in order that they may readily grip the upright portion 22 of bathtub 24 as shown in FIG. 2. The bathtub 24 is usually placed against a wall 26 with the upright portion 22 being the side from which an individual will enter the bathtub 24 filled with water 28 by the spout 30 by means of the valve handles 32 and 32'.

The internal member 12 is covered on its top surface 34 and bottom surface 36 by a soft sponge-like or padded material 38, preferably, the padded material 38 appearing on the top surface 34 of the internal member 12 is thicker than the padding 38' used to cover the bottom surface 36. A protective, preferably vinyl, slip-free material 40 is placed completely over the sponge-like material 38 and 38'. In order to make the protection apparatus 10 waterproof the edges 42, both parallel to the longitudinal axis 20 and transverse thereto are heat welded together in conventional manner so that the interior of the protection apparatus 10 will not absorb moisture and form mildew, since no water is permitted to enter the sponge-like padded material 38.

Figure 3:
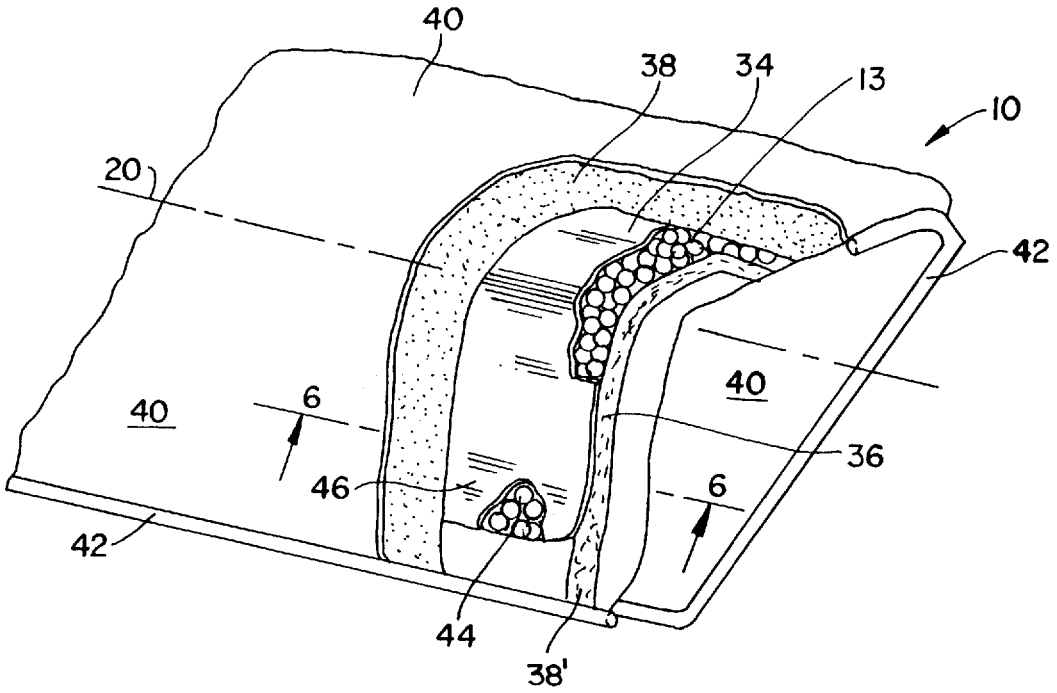
FIG. 3 is a pictorial representation of an alternative embodiment of the apparatus with a portion cut away.
Figure 4:
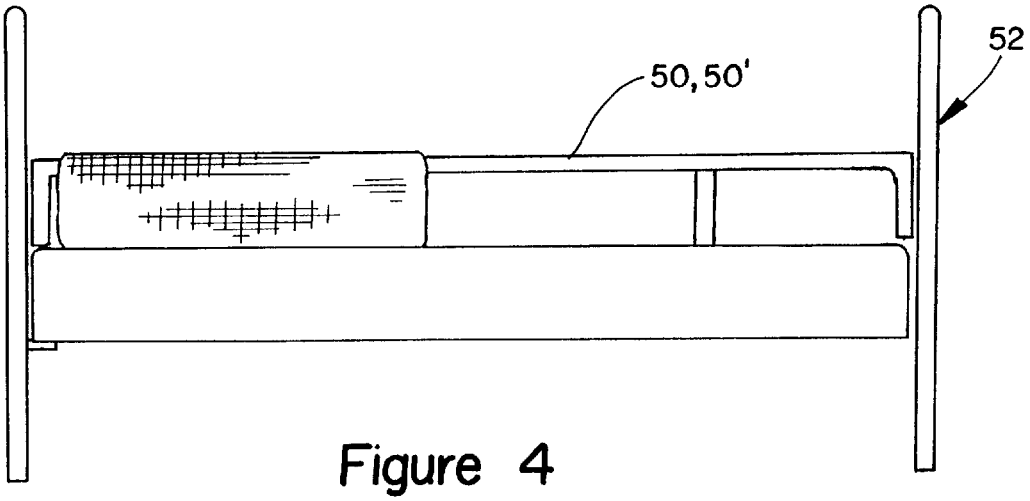
FIG. 4 is a pictorial representation of the apparatus shown in FIGS. 1 or 3 draped over the edge of a guardrail of a bed.
Figure 6:
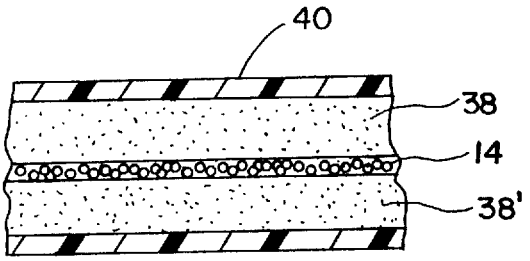
FIG. 6 is a greatly enlarged cross-sectional view of the apparatus shown in FIG. 3 taken along the line 6—6 shown in FIG. 3.

In the alternative embodiment, shown in FIG. 3, like numerals have been used to define like components for the ease in understanding the present invention.

The internal member 12 shown in FIG. 1 is replaced by internal member 13, which in the embodiment, shown in FIG. 3, includes a plurality of spherical pellets, such as buck shot or B—B's 44 placed within a closed bag 46 that functions as the internal member 12 and has its top surface 34 and its bottom surface 36 covered by a sponge-like material 38 as in the embodiment shown in FIG. 1. Thereafter a slip free material 40 is placed over the top and bottom surfaces of the sponge-like material 38 and is sealed around the longitudinal edges 42, which are parallel to the longitudinal axis 20, as well as the edges 42 which are transverse to the longitudinal axis 20. Since the internal member 13 is completely flexible as is the padded sponge-like material 38, the protection apparatus 10 may readily be draped over the narrow edge of bed guardrails 50 and 50' thereby protecting an individual confined to the bed from trying to hurt themselves by hitting their head against the guardrail. It will be understood that various changes in the details, materials, arrangement of parts and operating conditions, which have been herein described and illustrated in order to explain the invention, may be made by those skilled in the art within the principals and scope of the present invention.

In operation, a protection apparatus 10 may be placed over the upright edge portion of a bathtub to protect a person from falling thereagainst. Preferably the length of the protective device is made to extend along the open upright portion 22 of the bathtub 24 and may incorporate one or two such devices, if there are no shower doors mounted on the tub. The protection apparatus 10 may be manufactured in various lengths in order to accommodate various lengths of guardrail on beds and open space available on a bathtub. Therefore by placing the protection apparatus 10 over the open edge of a bathtub and/or guardrail one would provide the protection needed for an elderly person or a person with an interest in hurting himself by hitting his/her head against the guardrail.

Hereinbefore has been disclosed a protection apparatus suitable for use on the open edge of a bathtub and, in addition, may be utilized to protect an individual by placing it over the guardrail of a hospital bed.

Having thus set forth the nature of the invention, what is claimed is:

1. A protective cushion apparatus, comprising:

A. a longitudinally extending internal member having a top surface and a bottom surface for being draped over a hard, relatively narrow edge, said internal member including two longitudinally extending spaced apart hinges forming a generally U-shaped member in cross-section, having two arms and a base portion, said hinges providing a force for biasing said two arms together;

B. protective cushioning means covering said internal member top surface and said internal member bottom surface for softening a blow, thereby protecting an individual who may fall thereagainst; and C. protective covering means for completely covering said protective cushioning means.

2. A protective cushion apparatus according to claim 1, wherein said internal member is formed as a generally U-shaped member, in cross-section, having two arms and a base portion, said arms being in close proximity to each other and sufficiently flexible to permit the relatively narrow edge to be received into the space between said two arms.

3. A protective cushion apparatus according to claim 1, wherein said internal member is fabricated from a heavy mesh material.

4. A protective cushion apparatus according to claim 1, wherein said protective cushioning means is fabricated from a padded sponge-like material.

5. A protective cushion apparatus according to claim 4, wherein said protective cushioning means covering said internal member top surface is thicker than said protective cushioning means covering said internal member bottom surface.

6. A protective cushion apparatus according to claim 4, wherein said protective cushioning means covering said internal member top surface is at least twice as thick as said protective cushioning means covering said internal member bottom surface.

7. A protective cushion apparatus according to claim 1, wherein said protective covering means is slip free and water proof.

8. A protection cushion apparatus according to claim 7, wherein said protective covering means is completely sealed along all edges.

9. A protective cushion apparatus according to claim 7, wherein said protective covering means is completely sealed along all edges by heat sealing.

10. A protective cushion apparatus, comprising:

A. a longitudinally extending internal member having a top surface and a bottom surface for being draped over a hard, relatively, narrow edge; said internal member including two longitudinally extending spaced apart hinges forming a generally U-shaped member, in cross-section, having two arms and a base portion, said hinges providing a force for biasing said two arms together;

B. protective cushioning means, fabricated from a padded sponge-like material, covering said internal member top surface and said internal member bottom surface, said protective cushioning means covering said internal member top surface being thicker than said protective cushioning means covering said internal member bottom surface; and C. protective covering means for completely covering said protective cushioning means, said protective covering means being slip free, water proof and completely sealed along all edges.

* * * * *